US005697548A

United States Patent [19]

Halsell, II

[11] Patent Number: 5,697,548

[45] Date of Patent: Dec. 16, 1997

[54] TRAY-STYLE CARTON HAVING REINFORCED SIDE WALLS

[75] Inventor: H. Lee Halsell, II, Mountainburg, Ark.

[73] Assignee: The Mead Corporation, Dayton, Ohio

[21] Appl. No.: 629,250

[22] Filed: Apr. 8, 1996

[51] Int. Cl.[6] ..... B65D 21/032

[52] U.S. Cl. ..... 229/163; 206/587; 229/191; 229/916; 229/919

[58] Field of Search ..... 229/101, 120.12, 229/120.18, 163, 191, 915, 916, 917, 919; 206/503, 509, 587, 591

[56] References Cited

U.S. PATENT DOCUMENTS

| | | | |
|---|---|---|---|
| D. 361,892 | 9/1995 | Quaintance | D3/305 |
| 1,657,515 | 1/1928 | Miller | 229/916 |
| 1,664,308 | 3/1928 | Miller | 229/916 |
| 1,706,804 | 3/1929 | Miller | 229/916 |
| 2,347,422 | 4/1944 | Loth | 229/109 |
| 2,372,312 | 3/1945 | Buttery | 229/109 |
| 2,967,655 | 1/1961 | Seger, Jr. | 229/109 |
| 3,086,689 | 4/1963 | Wiedenmeier | 206/587 |
| 4,081,124 | 3/1978 | Hall . | |
| 4,341,338 | 7/1982 | Arnold | 229/919 |
| 4,417,686 | 11/1983 | Wozniacki | 229/117.16 |
| 4,441,649 | 4/1984 | Nederveld | 229/109 |
| 4,607,750 | 8/1986 | Valenti | 206/587 |
| 4,614,298 | 9/1986 | Cherry | 229/109 |
| 4,676,429 | 6/1987 | Crowe et al. | 229/109 |
| 4,702,408 | 10/1987 | Powlenko | 229/101 |
| 4,817,803 | 4/1989 | Risucci | 229/120.12 |
| 4,948,033 | 8/1990 | Halsell, II et al. | 229/191 |
| 5,147,271 | 9/1992 | Bacques et al. . | |
| 5,419,486 | 5/1995 | Bennett et al. | 229/109 |
| 5,485,951 | 1/1996 | Phillips | 229/156 |

*Primary Examiner*—Gary E. Elkins
*Attorney, Agent, or Firm*—Michael V. Drew

[57] ABSTRACT

A bottom wall is formed from a plurality of bottom panels having unjoined adjacent edges. Side walls are formed from a plurality of side panels. Each side panel is foldably joined along a bottom edge to one of the bottom wall panels. Reinforcing posts are formed in the side walls by sets of reinforcing post panels. Each set of reinforcing post panels has a plurality of post panels foldably joining one another and foldably joined between side wall panels adjacent the unjoined edges of the bottom panels. An end closure is formed at each end of the carton by end panels foldably joined to end edges of the bottom and side wall panels and secured in face-to-face overlapping relationship.

7 Claims, 3 Drawing Sheets

B

TRAY-STYLE CARTON HAVING REINFORCED SIDE WALLS

BACKGROUND OF THE INVENTION

The invention relates to tray-style cartons, and more particularly to tray-style cartons formed from a blank and having reinforced side walls.

Tray-style cartons are useful in packaging but often lack the strength necessary for stacking. Cartons are often strengthened for stacking by adding reinforcing material to the walls of the carton. However, it is desirable to minimize material used to strengthen a carton in order to minimize the cost of the carton. It would be useful to provide a tray-like carton which is strengthened for stacking wherein the reinforcing material is minimized.

SUMMARY OF THE INVENTION

The present invention provides a tray-like carton whose stacking strength is increased while reinforcing material used to increase stacking strength is minimized. A bottom wall is formed from a plurality of bottom panels having unjoined adjacent edges. Side walls are formed from a plurality of side panels. Each side panel is foldably joined along a bottom edge to one of the bottom panels. Reinforcing members are formed in the side walls by sets of reinforcing post panels. Each set of reinforcing post panels has a plurality of post panels foldably joining one another and foldably joined between wall panels adjacent the unjoined edges of the bottom panels. An end closure is formed at each end of the carton by end panels foldably joined to end edges of the bottom and side panels and secured in face-to-face overlapping relationship.

Other features and advantages of the present invention will be apparent from the following description, the accompanying drawings, and the appended claims.

DETAILED DESCRIPTION OF THE PREFERRED EMBODIMENT

Figure 1:
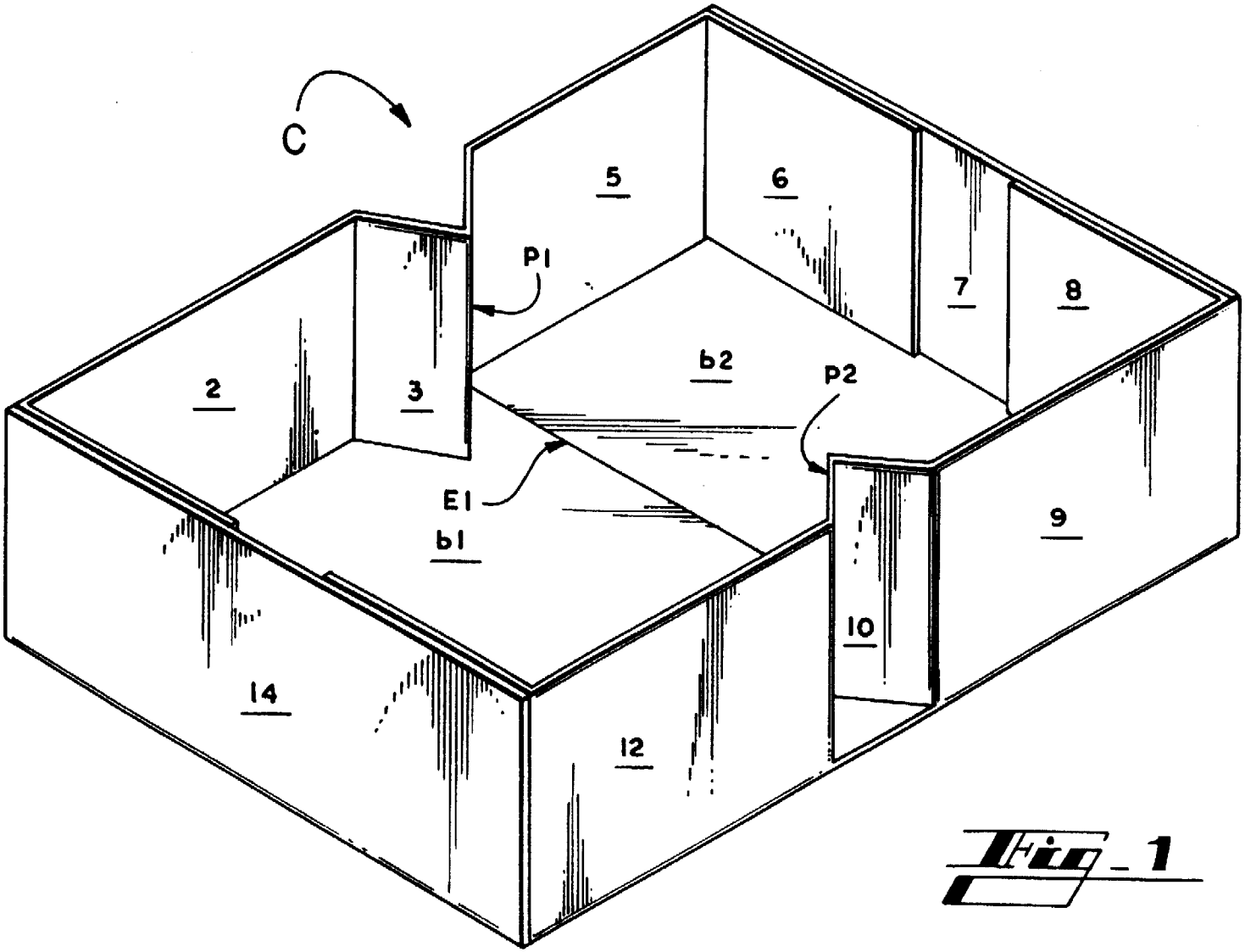
FIG. 1 is an isometric illustration of a tray-style carton formed from a blank having reinforced side walls, according to a preferred embodiment of the present invention.

The present invention provides a tray-like carton whose stacking strength is increased through use of a reinforced side wall wherein the material used to reinforce the side wall is minimized. Referring first to the isometric illustration of FIG. 1, therein is shown a tray-like carton C erected from a blank, having reinforced side walls, according to a preferred embodiment of the invention. To simplify understanding of the invention, reference may be made simultaneously to FIGS. 1, 2 and 3. The bottom wall for the carton is formed from bottom panels b1 and b2. These panels b1, b2 lie adjacent one another at respective edges E1 and E2 shown in FIG. 2.

Side walls are formed by side panels 2, 5, 9, 12 which are foldably joined to the bottom panels b1, b2. Reinforcing post P1, P2 are formed in the side walls by post panels 3, 4 and 11, 10. The reinforcing posts, or members, P1, P2 are joined to the side walls between the ends of the side walls and divide the side walls into side panels 2, 5, 9, 12. The posts/members P1, P2 and unjoined edges E1, E2 of bottom panels b1, b2 are adjacent one another.

The ends of the carton C may be secured by commonly used carton end closures. In the preferred embodiment, end panels 1, 6, 7, 8, 13, 14 are foldably joined to the end edges of the respective side and bottom panels 2, 5, b2, 9, 12, and b1 to form end closures.

Figure 2:
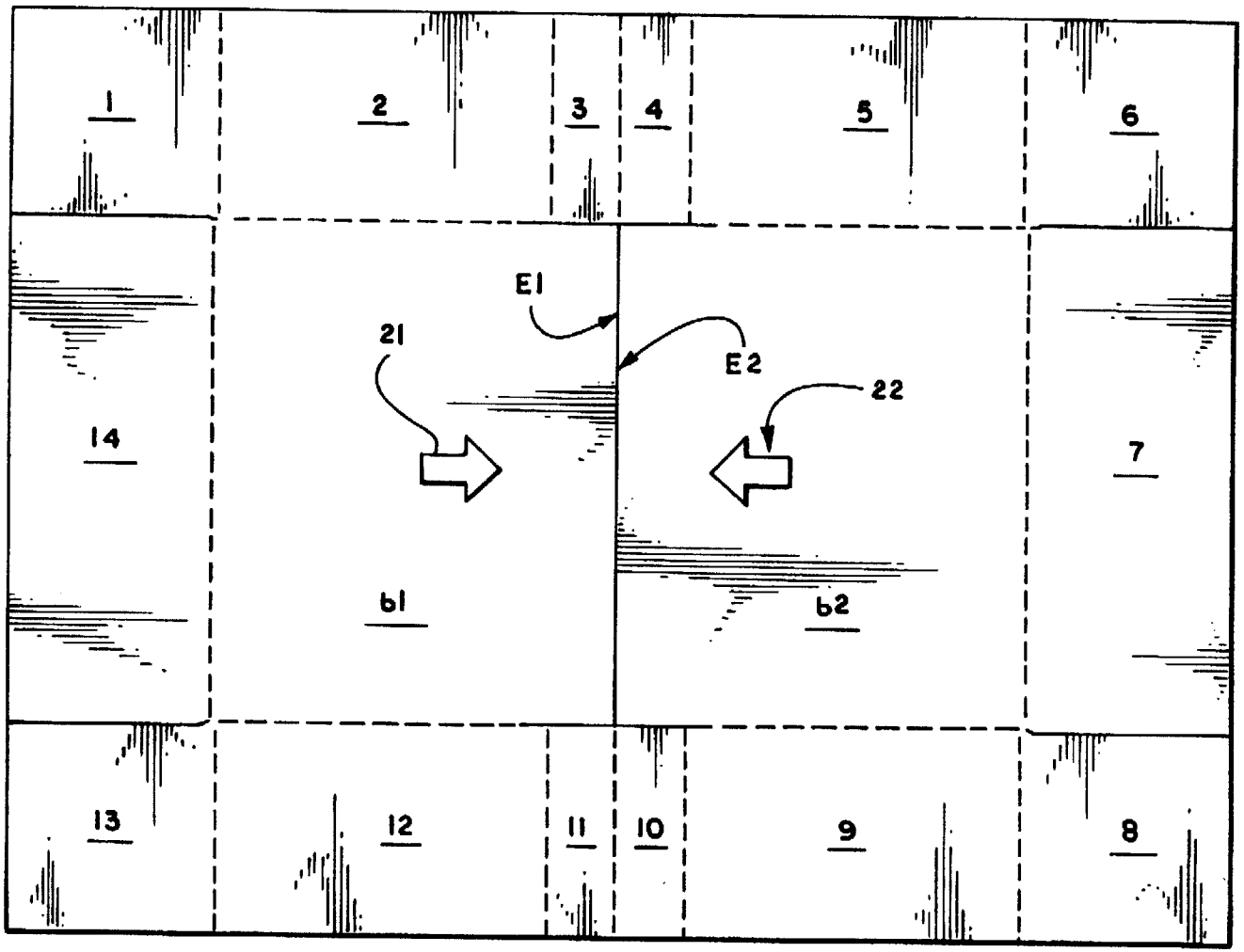
FIG. 2 is a plan view of a schematic representation of a blank for forming the carton of FIG. 1.
Figure 3:
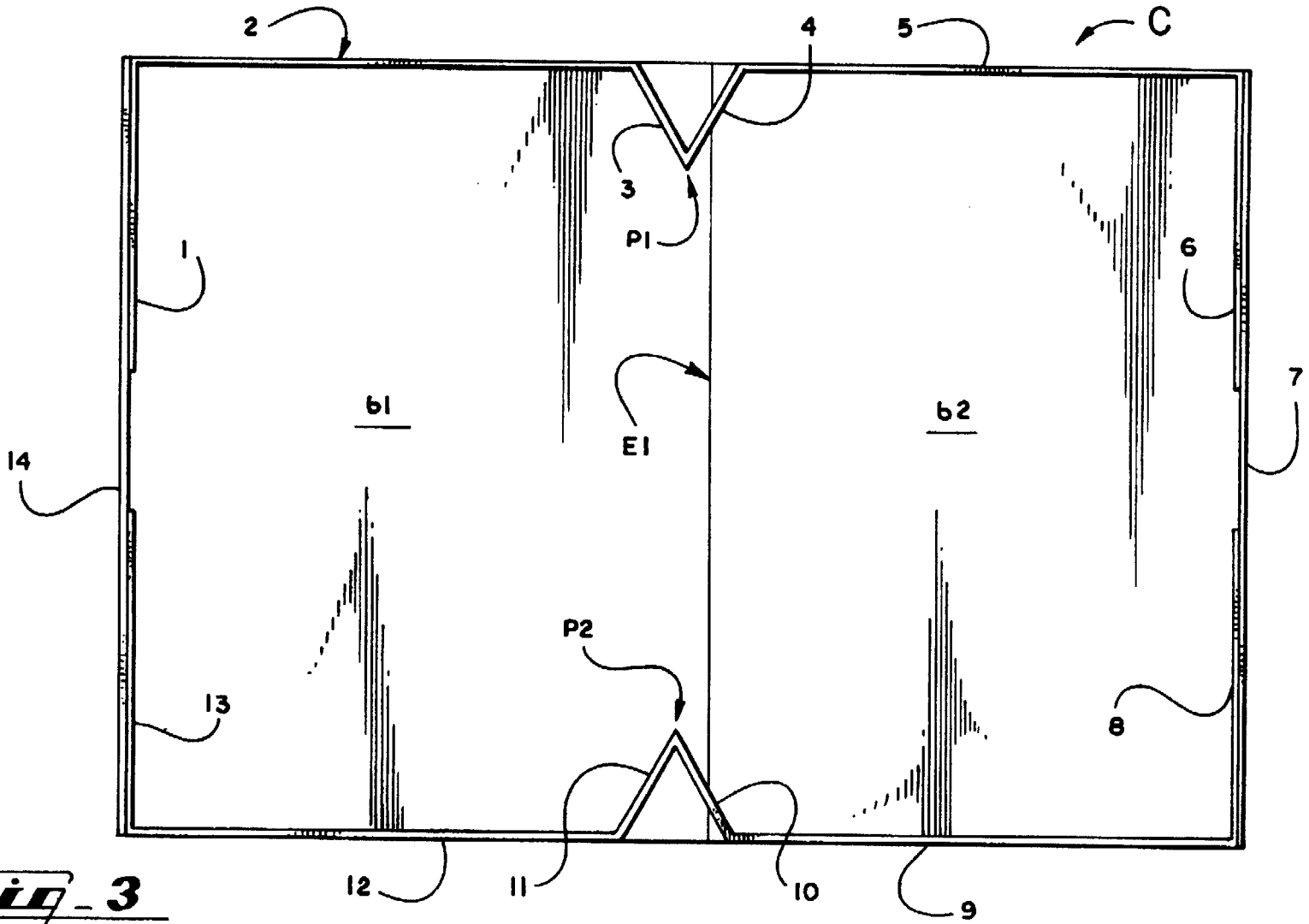
FIG. 3 is a top plan view of the erected carton of FIG. 1.

In the blank B all of the carton-forming elements are coplanar. The carton C is placed into erected condition from the blank B by folding the side walls 2, 5, 9, 12 into upright position. Referring now particularly to FIG. 2, the bottom wall is placed into carton-forming position by moving each bottom panel b1, b2 toward one another in the direction illustrated by arrows 21, 22 into overlapping condition. Although either bottom wall panel may overlap the other, a suitable overlapping is shown wherein the free edge E1 of bottom panel b1 overlaps the free edge E2 of bottom panel b2. The faces of bottom panels b1, b2 are secured to one another by known carton forming securement means such as adhesion or use of fasteners. When the bottom panels b1, b2 are translated into overlapping relationship, the panels in each set of side panels 2, 5 and 9, 12 are urged toward one another thereby causing the post panels 3, 4 and 10, 11 to fold outwardly of the plane of the side wall and side panels 2, 5 and 9, 12. Each set of post panels 3, 4 and 10, 11 is thus forced into folded upright angular relationship with respect to one another forming reinforcing posts P1, P2, respectively. The end closures for the carton are formed by standard carton closure means as previously described and illustrated by folding and overlapping securement of end panels 1, 14, 13 and 6, 7, 8.

The stacking strength of the carton is greatly increased by the reinforcing posts P1, P2. The amount of material needed to form the reinforcing posts is minimized because the posts are formed from a one-piece blank and are essentially a part of the walls they help support.

Other modifications may be made in the foregoing without departing from the scope and spirit of the claimed invention.

What is claimed is:

1. A tray-style carton having reinforced side walls, the carton formed from a blank, comprising:

a substantially planar segmented bottom wall including a plurality of bottom panels having adjacent unjoined edges;

side walls foldably adjoining said bottom wall along transverse edges thereof at least one of said side walls having a reinforcing member foldably adjoined thereto mediate remote edges thereof adjacent said adjacent unjoined edges of said bottom wall dividing said at least one of said side walls into side panels adjoining said bottom panels, said reinforcing member projecting outwardly of a plane of said side wall; and end closure adjoining end edges of respective said bottom wall and said side walls;

wherein said adjacent unjoined edges of said bottom panels are secured in substantially planar overlapping condition urging said side panels of a respective said side wall toward one another.

2. The carton of claim 1, said side walls including opposing side walls each having a said reinforcing member.

3. The carton of claim 1, said segmented bottom wall having a quadrilateral configuration and said side walls including opposing side walls each having a said reinforcing member.

4. The carton of claim 1, said reinforcing member comprising a plurality of post panels foldably adjoining one another.

5. A blank for forming a tray-style carton, the blank comprising:

a segmented bottom wall including a plurality of bottom panels having adjacent unjoined edges;

side walls respectively transversely disposed with respect to said segmented bottom wall foldably adjoined thereto, at least one of said side walls having a reinforcing member foldably adjoined thereto mediate remote edges thereof adjacent said adjacent unjoined edges of said bottom wall dividing said at least of said side walls into side panels foldably adjoining said bottom panels such that when said adjacent unjoined edges of said plurality of bottom panels are secured in substantially planar overlapping condition said side panels of a respective said side wall are urged toward one another folding said reinforcing member outwardly of a plane of said at least one of said side walls.

6. The blank of claim 5, said reinforcing member comprising a plurality of post panels.

7. The carton of claim 6, wherein a fold line about which said plurality of post panels form said reinforcing member is coincident with a line demarking said adjacent unjoined edges of said bottom panels.

* * * * *